US006957524B2

(12) United States Patent
Lucas

(10) Patent No.: US 6,957,524 B2
(45) Date of Patent: Oct. 25, 2005

(54) METHOD OF SEALING A CONTAINER

(75) Inventor: Philip J. Lucas, Golden, CO (US)

(73) Assignee: Coors Global Properties, Inc., Lakewood, CO (US)

( * ) Notice: Subject to any disclaimer, the term of this patent is extended or adjusted under 35 U.S.C. 154(b) by 0 days.

(21) Appl. No.: 10/793,575

(22) Filed: Mar. 3, 2004

(65) Prior Publication Data

US 2004/0200796 A1 Oct. 14, 2004

Related U.S. Application Data

(62) Division of application No. 09/970,583, filed on Oct. 4, 2001, now Pat. No. 6,726,043.

(51) Int. Cl.[7] ..... B65B 7/28

(52) U.S. Cl. ..... 53/485; 53/488

(58) Field of Search ..... 53/485, 487, 488; 215/43, 45, 253, 254, 271, 317, 321, 250, 215/256; 220/266, 657, 658, 659, 270, 780

(56) References Cited

U.S. PATENT DOCUMENTS

| | | | | |
|---|---|---|---|---|
| 2,711,840 | A * | 6/1955 | Gits et al. | 220/780 |
| 3,673,761 | A * | 7/1972 | Leitz | 53/488 |
| 3,677,431 | A * | 7/1972 | Westfall | 215/318 |
| 5,368,178 | A * | 11/1994 | Towns et al. | 215/317 |
| 5,657,617 | A * | 8/1997 | Allen et al. | 53/487 |
| 5,660,290 | A * | 8/1997 | Hayes | 215/252 |

* cited by examiner

*Primary Examiner*—John Sipos
(74) *Attorney, Agent, or Firm*—Klaas, Law, O'Meara & Malkin, P.C.; Michael A. Goodwin; William P. O'Meara

(57) ABSTRACT

A method of sealing a container including a container and a closure member for sealing the container over a range of internal pressure.

4 Claims, 11 Drawing Sheets

METHOD OF SEALING A CONTAINER

This is a divisional of application Ser. No. 09/970,583 filed Oct. 4, 2001, for CONTAINER, CONTAINER CLOSURE MEMBER AND METHOD of Philip J. Lucas, now U.S. Pat. No. 6,726,043, which is hereby incorporated by reference for all that is disclosed therein.

FIELD

The present invention relates generally to sealed containers, and more particularly to a closure member for sealing a container.

BACKGROUND

Containers are used for a variety of applications. One particular application is the storage and distribution of liquids, such as tonic water, soda pop, beer, etc.

One type of container is a bottle. Bottles may be manufactured by a number of manufacturing processes including, for example, parison blow molding, extrusion blow molding and injection molding. One such manufacturing process that has been commonly employed in the beverage industry is parison blow molding of glass.

Containers, such as bottles, are typically sealed by closure members. Closure members may be a variety of common elements such as corks, crowns or twist-off caps, to name a few. Typically, glass beverage bottles are sealed by closure members referred to as crowns. Crowns have conventionally been composed of steel and have a liner provided therein. Steel crowns are commonly made by a stamped metal fabrication process and are thereafter treated to prevent rust formation. The liner is provided as a seal between the top-most surface of the bottle, often referred to as the top-finish, and the crown. The liner is typically manufactured out of a soft urethane, soft plastic, latex, rubber or the like.

In order to seal a conventional glass bottle, the crown is placed over the top of the bottle after filling. The crown is then pressed onto the bottle such that the crown is formed (i.e. 'bent') around the top of the bottle. As such, the liner is urged against the top-finish, thereby providing a sealed container.

SUMMARY

In one embodiment, the present disclosure may comprise a sealed container comprising: a container defining a central longitudinal axis and a second axis intersecting the central longitudinal axis, wherein the second axis extends perpendicular to the central longitudinal axis, the container comprising: a container interior within the container; a container exterior oppositely disposed with respect to the container interior; an opening providing fluid communication between the container interior and the container exterior; a first sealing surface at least a portion of which lies on a third axis formed on the container exterior, wherein the third axis extends transverse to the second axis; a quantity of a liquid contained within the container interior; a closure member sealing the opening, the closure member comprising: a first wall portion comprising a first wall portion first surface; a second wall portion extending from the first wall portion, the second wall portion comprising a second wall portion first surface; wherein, at least a portion of the second wall portion first surface is adjacent to the first sealing surface; wherein, at least a portion of the first wall portion first surface is exposed to the quantity of the liquid; and wherein the quantity of the liquid has a gas dissolved therein.

In another embodiment, the present disclosure may also comprise a plastic, thread-less closure member for sealing a container comprising a container interior at a container interior pressure, the closure member comprising: a first wall portion comprising a first wall portion first surface and a first wall portion second surface oppositely disposed from the first wall portion first surface; a second wall portion extending from the first wall portion, the second wall portion comprising a second wall portion first surface at least a portion of which lies on a third axis and a second wall portion second surface oppositely disposed relative to the second wall portion first surface; a helical frangible portion formed on at least a portion of the second wall portion; and wherein, the first wall first surface is exposed to the container interior pressure.

In another embodiment, the present disclosure may also comprise a sealed container comprising: a container, the container comprising: a container interior within the container; a container exterior oppositely disposed with respect to the container interior; an opening providing fluid communication between the container interior and the container exterior; a container first sealing surface formed on the container exterior; a quantity of a liquid contained within the container interior; a closure member sealing the opening, the closure member comprising a closure member first surface thereon; wherein, the sealed container comprises at least a first condition and a second condition; wherein, in the first condition: the container interior is at a first pressure; and at least a portion of the closure member first surface applies a first level of force to at least a portion of the container first sealing surface; wherein, in the second condition: the container interior is at a second pressure; and the at least a portion of the closure member first surface applies a second level of force to the at least a portion of the container first sealing surface; and wherein, the second pressure is greater than the first pressure and the second level of force is greater than the first level of force.

In another embodiment, the present disclosure may also comprise a method of sealing a container comprising: providing a container defining a central longitudinal axis and a second axis intersecting the central longitudinal axis, wherein the second axis extends perpendicular to the central longitudinal axis, the container comprising: a container interior within the container; a container exterior oppositely disposed with respect to the container interior; an opening providing fluid communication between the container interior and the container exterior; a first sealing surface at least a portion of which lies on a third axis formed on the container exterior, wherein the third axis extends transverse to the second axis; providing a closure member comprising: a first wall portion comprising a first wall portion first surface; a second wall portion extending from the first wall portion, the second wall portion comprising a second wall portion first surface; dispensing a quantity of a liquid into the container interior; moving the closure member into contact with the container; causing at least a portion of the second wall portion first surface to sealingly engage the first sealing surface; and exposing at least a portion of the first wall portion first surface to the quantity of the liquid.

DETAILED DESCRIPTION

Figure 1:
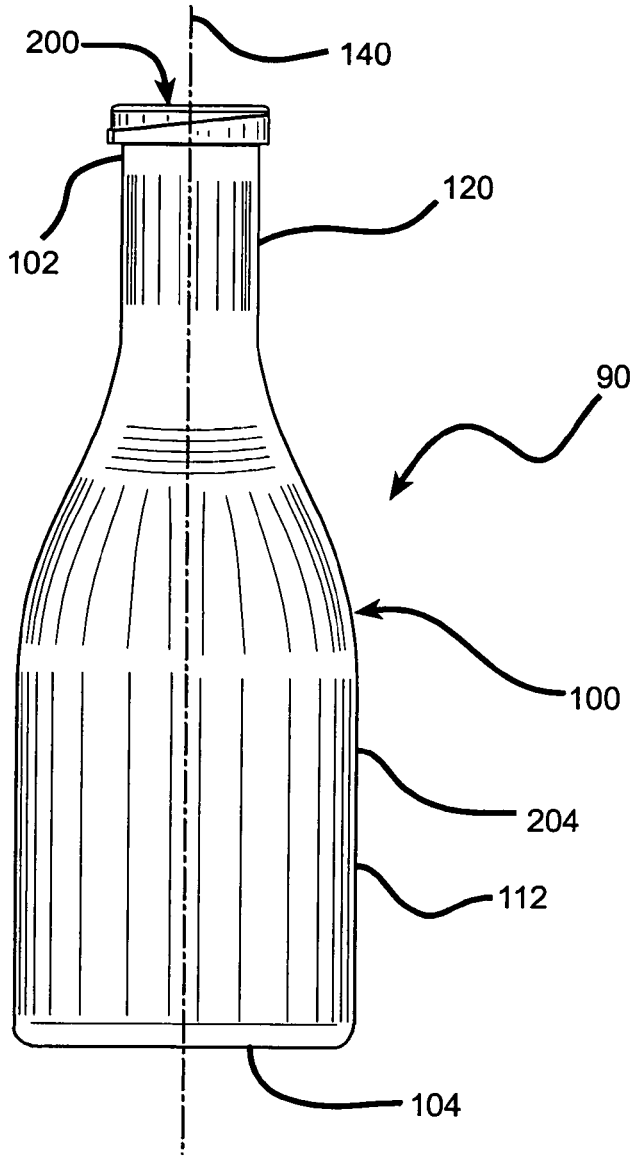
FIG. 1 is a side elevation view of a sealed container having a bottle and a crown attached thereto.

With reference to FIG. 1, a sealed container 90 may include a container 100 and a closure member 200. For descriptive purposes only, the container 100 may be referred to herein as a bottle 100. Additionally, for descriptive purposes only, the closure member 200 may be referred to herein as a crown 200.

With further reference to FIG. 1, the bottle 100 may be provided with a top portion 102, a bottom portion 104, a circumferential wall 106 and a neck 120. Construction for the bottle 100 may result in a cylindrical geometry having a larger diameter near the bottom portion 104 and a smaller diameter near the top portion 102. It is noted, however, that the bottle may be manufactured in any of a variety of geometries. The neck 120, circumferential wall 106 and the bottom portion 104 may define a relatively thin walled object having an opening 108 (FIG. 5), a container interior 110 (FIG. 5) and a container exterior 112.

Figure 5:
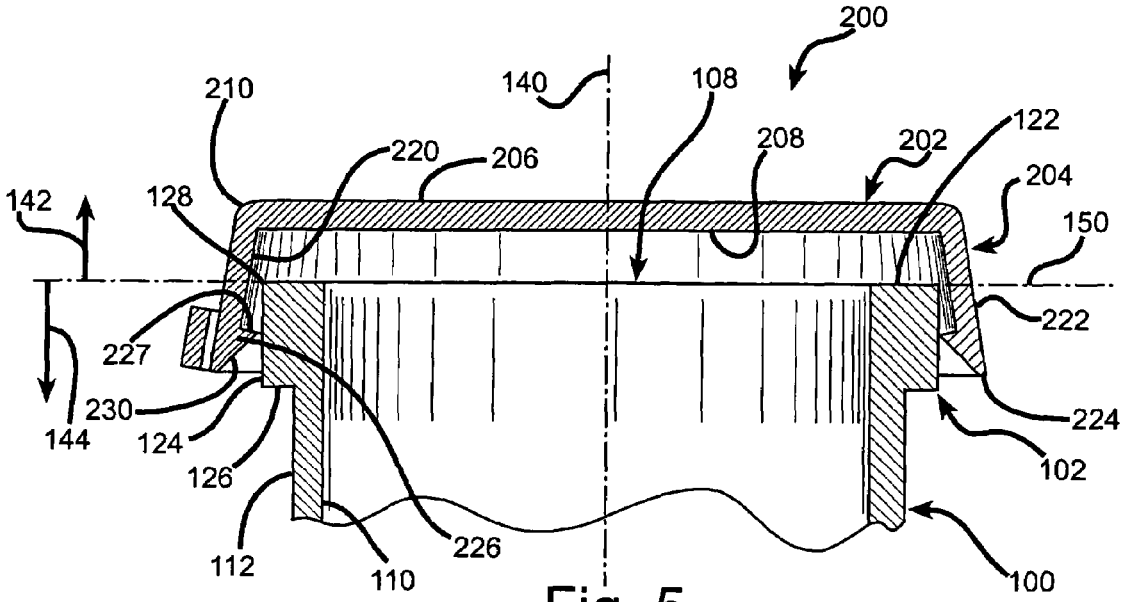
FIG. 5 is a cross-section view of the crown illustrated in FIG. 1 taken along the line 5—5 of FIG. 3 during installation on the bottle.

The bottle 100 may be made of a number of compositions, such as plastic or glass. With reference to FIG. 5, the bottle 100 may be provided with various features in the top portion 102. The bottle 100 may be provided with an upper-most portion 122, hereinafter referred to as a top finish 122, a first sealing surface 124 and a second sealing surface, hereinafter referred to as a catch sealing surface 126. The top finish 122 is provided on the top portion 102 of the bottle 100. The opening 108 is provided through the top finish 122 to allow for fluid communication between the container interior 110 and the container exterior 112. The first sealing surface 124 may be provided on the exterior 112 of the bottle at the top portion 102. The first sealing surface 124 may be formed having a cylindrical geometry adjacent to the top finish 122. A bottle corner 128 may be located at the transition from the top finish 122 and the first sealing surface 124. Although the bottle corner 128 is shown in the drawings as a 'sharp' corner for illustrative purposes, it is to be understood that as manufactured, features on bottles such as bottle corner 128 commonly have fillets or chamfers due to manufacturing concerns. The catch sealing surface 126 may be provided just below the first sealing surface 124. The catch sealing surface 126 may be substantially parallel to the top finish 122 and adjacent to the first sealing surface 124. As discussed later in detail, the first sealing surface 124 and catch sealing surface 126 may be formed having tapered angles in an alternative embodiment. Additionally, the geometry of the first sealing surface 124 and the catch sealing surface 126 may be curved or otherwise altered from the embodiments as shown in the drawings; for example, the sealing surfaces 124, 126 may be concave, convex, have circumferential ribs or other profile variations.

In order to assist with the description of the present apparatus, a coordinate system has been utilized. It is noted that, the coordinate system is not an actual physical feature of the bottle 100 or the crown 200, but merely a tool utilized for descriptive purposes only. The coordinate system may comprise a central longitudinal axis 140, FIG. 1. With reference to FIG. 5, the central longitudinal axis 140 is a line that extends infinitely in both a first direction 144 and an oppositely disposed second direction 142. For clarity of description, the direction 142 may be referred to herein as the upward direction 142 and the direction 144 may be referred to herein as the downward direction 144, it being understood, of course, that these terms are relative, depending upon the orientation of the bottle 100. Both the upward and the downward directions 142, 144 originate at the top finish 122. The central longitudinal axis 140 is aligned with a theoretical center of the bottle 100. As such, the central longitudinal axis 140 is an approximated center axis of the bottle 100. Since the central longitudinal axis 140 extends beyond the confines of the bottle 100, the central longitudinal axis 140 travels through the center of the opening 108 and the center of the bottom portion 104 (FIG. 1).

With reference to FIG. 5, another axis of the coordinate system is a second axis 150. The second axis 150 is a reference line that intersects the central longitudinal axis 140 forming a perpendicular intersection. As shown in the exemplary embodiment, the second axis 150 is coplanar to the bottle top finish 122. It is noted, however, that this location of the second axis 150 is an exemplary point of intersection provided at this location for descriptive purposes only. The second axis 150 may alternatively intersect the central longitudinal axis 140 at any point. Additionally, the second axis 150 extends infinitely in both directions from the intersection with the central longitudinal axis 140.

Figure 2:
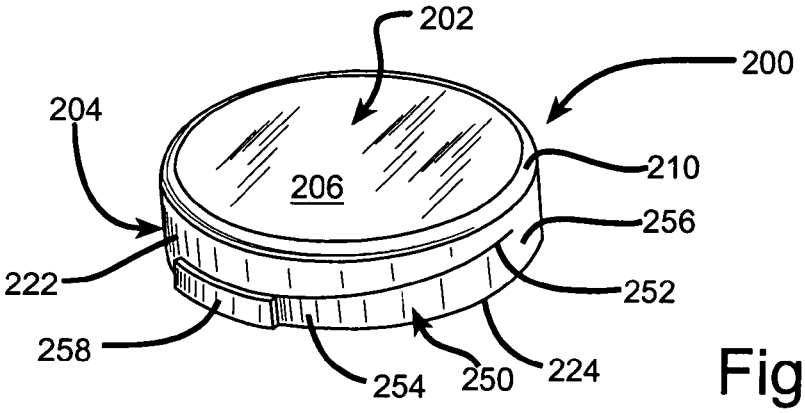
FIG. 2 is a perspective view of the crown illustrated in FIG. 1.
Figure 3:
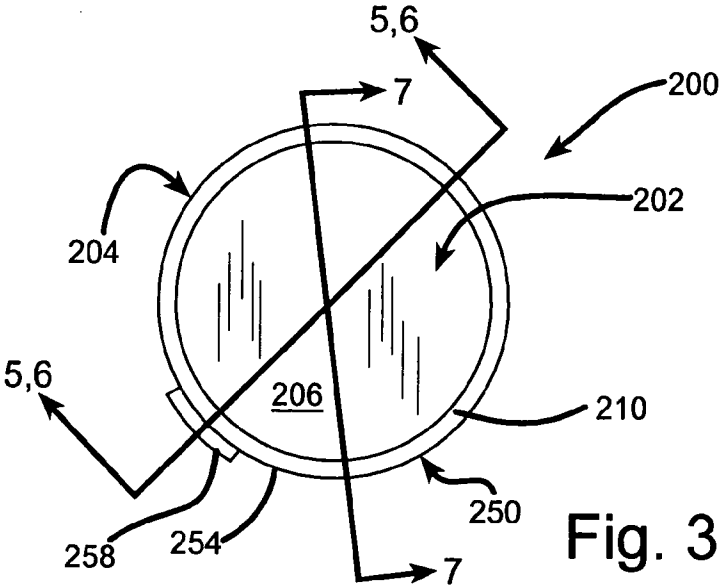
FIG. 3 is a plan view of the crown illustrated in FIG. 1.

Referring to FIG. 5, a crown 200 is provided with the sealed container 90 (FIG. 1). The crown 200 is a closure device utilized to encapsulate the interior 110 of the bottle, thereby separating the container interior 110 from the external environment. With reference to FIG. 2, the crown 200 is provided with a first wall portion 202 and a second wall portion 204. For descriptive purposes only, the first wall portion 202 will hereinafter be referred to as a top plate 202. Additionally, the second wall portion 204 will hereinafter be referred to as a skirt 204. The top plate 202 is provided with an upper surface 206, an oppositely disposed first wall portion first surface 208 and an edge chamfer 210. For descriptive purposes only, the first wall portion first surface 208 will hereinafter be referred to as a lower surface 208 (FIG. 5). The upper and lower surfaces 206, 208 and the edge chamfer 210 define a disk-like geometry of slightly greater diameter than the top finish 122 of the bottle 100. The crown 200 may be manufactured from any of a number of materials, including plastic. Examples of suitable plastics from which the crown may be manufactured include polyethylene and polypropylene.

Figure 15:
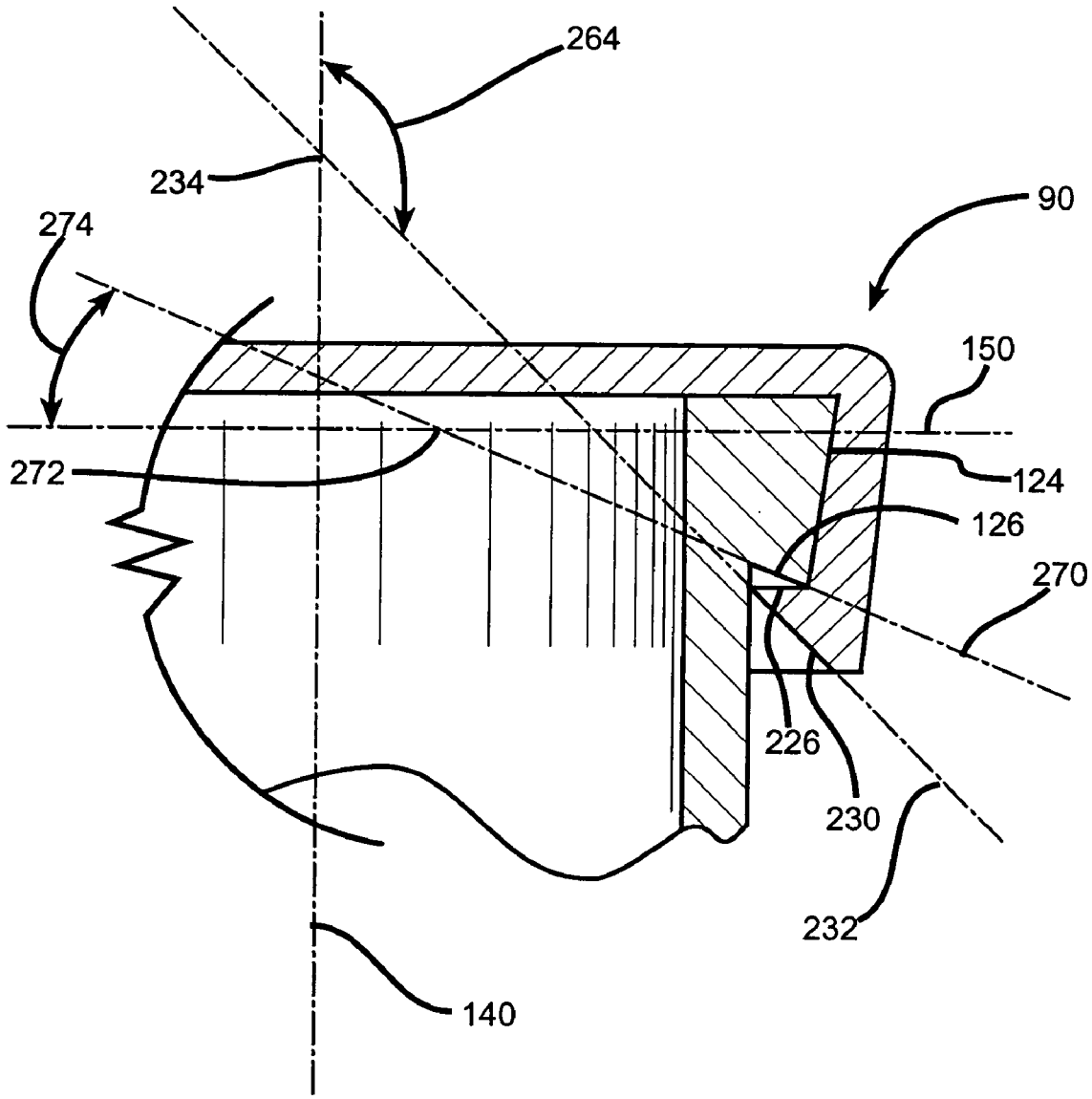
FIG. 15 is a partial cross-section view of an alternative embodiment of the crown of FIG. 1 having the tapered first sealing surface of FIG. 14 and a tapered catch sealing surface.

With reference to FIG. 5, the skirt 204 may be provided on the lower surface 208 of the top plate 202. The skirt 204 may define a substantially cylindrical geometry of slightly larger geometry than the first sealing surface 124 of the bottle 100. The skirt 204 is provided with a second wall portion first surface 220, an oppositely disposed second wall portion second surface 222 and a bottom portion 224. For descriptive purposes only, the second wall portion first surface 220 will hereinafter be referred to as an skirt inside surface 220. Additionally, the second wall portion second surface 222 will hereinafter be referred to as a skirt outside surface 222. The skirt 204 may be further provided with a third wall portion 226. For descriptive purposes only, the third wall portion 226 will hereinafter be referred to as a catch 226. The catch 226 may be provided with a third wall portion first surface 227. The catch 226 may protrude from the skirt inside surface 220 near the skirt bottom portion 224. The catch 226 may form a continuous circumferential feature around the entire inside surface 220. The skirt 204 may be further provided with a ramp 230. The ramp 230 may form an internal chamfer on the skirt bottom portion 224. With reference to FIG. 15, a ramp reference geometry may be defined by revolving a fifth axis 232, hereinafter referred to as a ramp reference line 232 about the central longitudinal axis 140. The ramp reference line 232 intersects the central longitudinal axis 140 at a ramp vertex point 234. A third angle 264, hereinafter referred to as a ramp angle 264, indicating the angle between the ramp reference line 232 and the central longitudinal axis 140 is shown in FIG. 15. The revolution of the ramp reference line 232 defines the three-dimensional ramp reference geometry representative of the plane upon which at least a portion of the ramp 230 resides. In the exemplary embodiment as shown, the ramp angle 264 is about 120 degrees, however, it is noted that the ramp angle 264 may be any obtuse angle.

Figure 4:
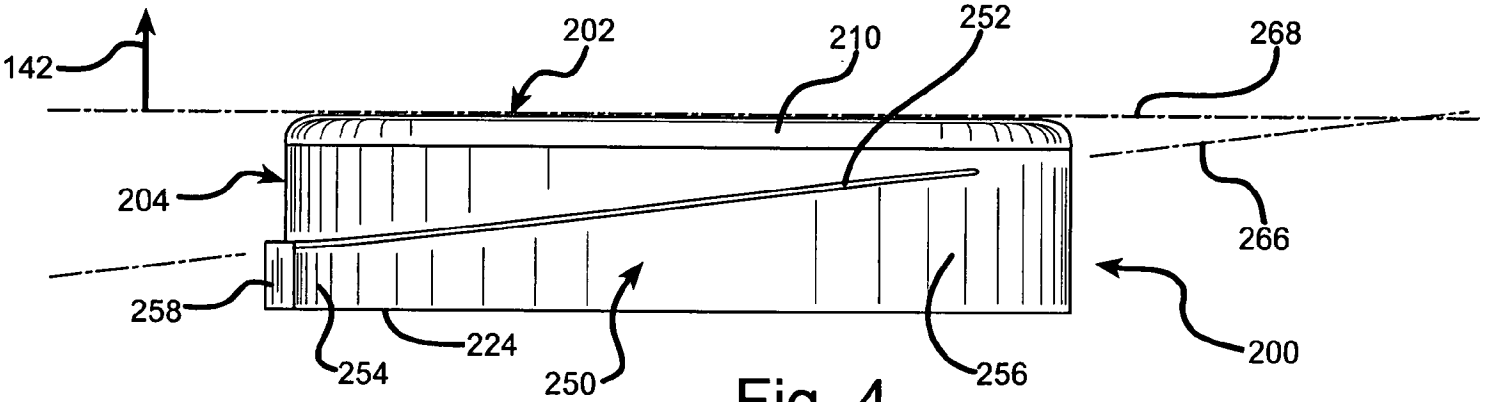
FIG. 4 is a side elevation view of the crown illustrated in FIG. 1.

With reference to FIG. 2, the skirt 204 may be further provided with a release 250. The release 250 may be defined by features provided on the skirt 204. Such features may include a helical frangible portion 252, a tear portion 254, an attached portion 256 and a tab 258. For descriptive purposes only, the helical frangible portion 252 will hereinafter be referred to as a score 252. The score 252 may be provided on the outside surface 222 of the skirt 204. With reference to FIG. 4, in an exemplary embodiment, the score 252 is a groove in the skirt 204. The score 252 provides a reduced wall thickness of the skirt 204, thereby providing a separation portion between the skirt 204 and the release 250. Additionally, the score 252 may be provided with a vertical portion 253 (FIG. 9) extending from the bottom portion 224 of the skirt 204. In the exemplary embodiment shown, the score 252 travels cylindrically and vertically in the upward direction 142 from the bottom portion 224 on the skirt 204 towards the top plate 202 in a helical manner. At least a portion of the score 252 may be located on a score reference plane 266 that intersects a top plate reference plane 268 as shown in FIG. 4. The tear portion 254 may be located near the bottom portion 224 of the skirt 204 and attached to the tab 258. The attached portion 256 may be located on an opposite side of the release 250 from the tear portion 254. The attached portion 256 serves to retain the release 250 to the skirt 204 once the score 252 has been torn, as described later.

Figure 6:
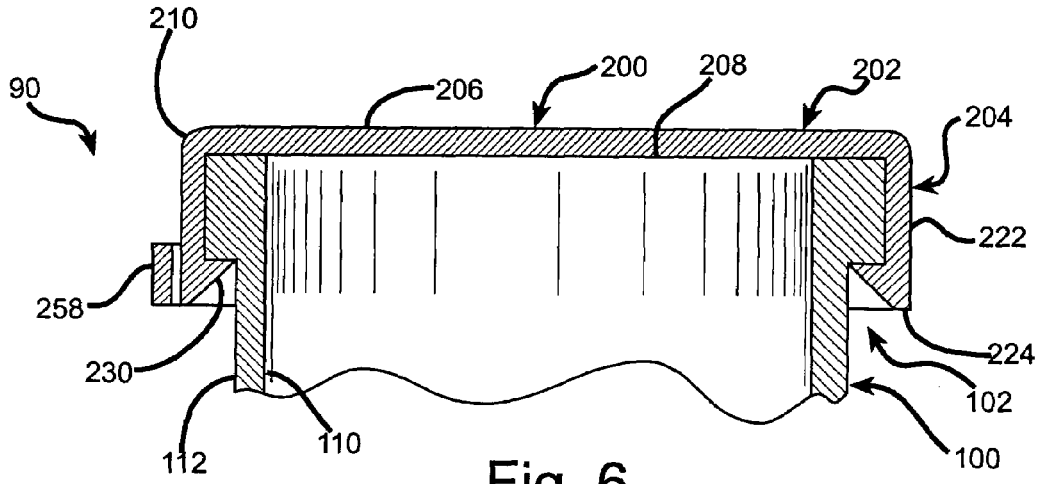
FIG. 6 is a cross-section view of the crown illustrated in FIG. 1 taken along the line 6—6 of FIG. 3 after installation on the bottle.

As shown in FIG. 5, the crown 200 is installed on the bottle 100 to produce the sealed container 90 (FIG. 6). During a filling operation, liquid is dispensed into the interior 110 of the bottle 100 through the opening 108. Liquid that may be dispensed into the bottle 100 may be any one of a variety of liquids. Such liquids may be aqueous solutions, or may alternatively have gas contained therein. Gas containing liquids may contain any of a variety of gases such as carbonaceous gas, inert gas or oxygenated gas. Once a sufficient amount of liquid has been dispensed into the bottle 100, the crown 200 is attached to the bottle 100. Attaching the crown 200 to the bottle 100 results in the sealed container 90.

With further reference to FIG. 5, the crown 200 is attached to the bottle 100 by positioning the skirt bottom portion 224 adjacent to the top finish 122 of the bottle 100. The crown 200 travels in the downward direction 144 until the ramp 230 contacts the bottle corner 128. The crown 200 is urged in the downward direction 144, thereby resulting in the deflection of the skirt 204. The skirt 204 deflects in a manner such that the circumference of the skirt 204 temporarily increases, thereby allowing the catch 226 to pass the bottle corner 128. While further traveling in the downward direction 144, the catch 226 slides on the first sealing surface 124. Once the crown 200 has traveled until the bottom portion 208 of the top plate 202 contacts top finish 122, the catch 226 'snaps' into contact with the catch sealing surface 126 as shown in FIG. 6. The deflection of the skirt 204 occurs due to the mechanical properties of the composition of the crown 200 and the present design disclosed herein. It is important to note that the installation of the crown 200 imparts forces on the crown 200 that do not substantially alter the shape of the crown 200. Therefore, the installation forces are less than forces that cause permanent deformation of the crown 200 (i.e. the forces are less than the elastic limit of the material). As such, the crown 200 retains similar dimensions after it is 'snapped' onto the bottle 100 as when it was manufactured.

Once the sealed container 90 is packaged for shipping, the sealed container 90 is delivered to a destination. It is important to note for later discussions that this distribution may result in agitation and/or elevated temperature of the sealed container 90. Agitation and elevated temperatures of the sealed container 90 may result in increases of internal pressure in liquids, particularly in gaseous liquids such as soda pop, tonic water, beer, seltzer water, etc. As such, the sealed container 90 requires a certain amount of capacitance for variations in internal pressure. Therefore, the sealed container 90 may provide sealing across a range of pressures to ensure that the liquid contained therein does not leak or spoil.

Figure 7:
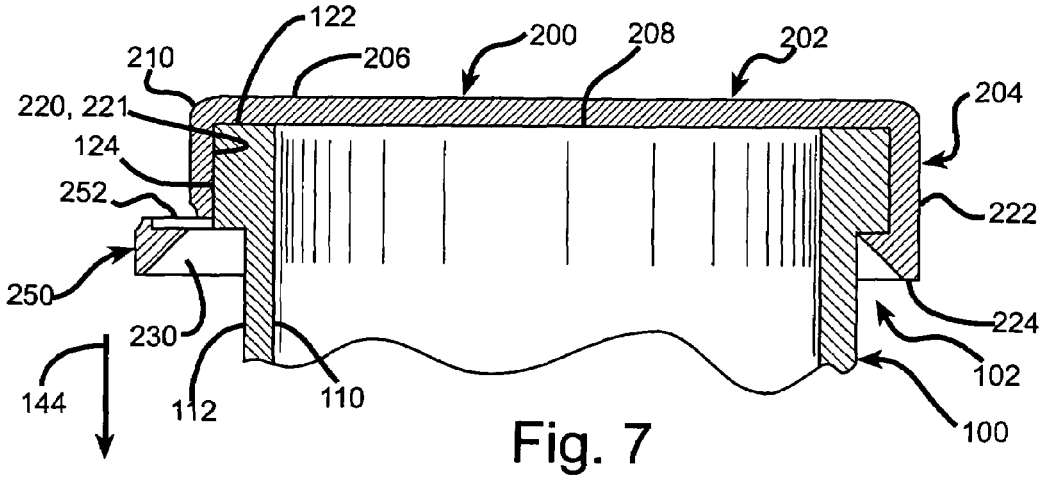
FIG. 7 is a cross-section view of the crown illustrated in FIG. 1 taken along the line 7—7 of FIG. 3 showing a score that has been broken to free a release portion from a skirt.
Figure 8:
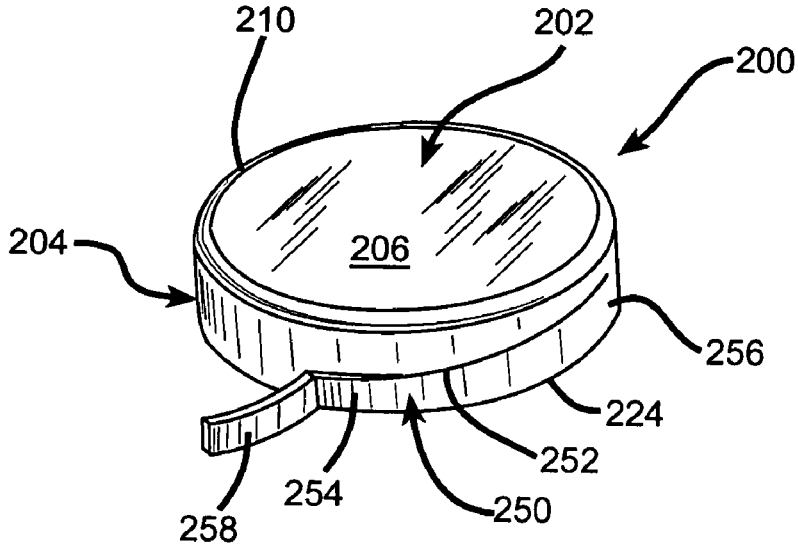
FIG. 8 is a perspective view of the crown of FIG. 7 after a tab has been pulled to initiate freeing of the release portion from the skirt.
Figure 9:
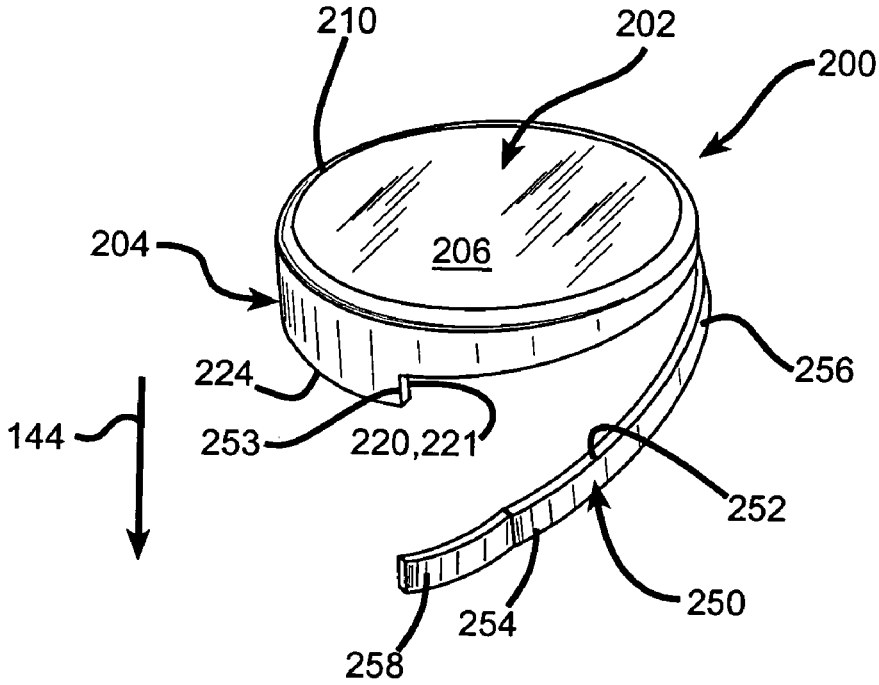
FIG. 9 is a perspective view of the continued freeing of the release portion from the crown of FIG. 8.

At some point in time after filling and distribution, the sealed container 90 is opened by a consumer. With reference to FIG. 8, to open the sealed container 90, the consumer pulls the tab 258 on the crown 200. By pulling the tab 258, the score 252 breaks, detaching the tear portion 254 of the release 250 from the skirt 204. As shown in FIG. 7, the detaching of the release 250 results in movement of a portion of the catch 226 out of engagement with the catch sealing surface 126. Since the catch 226 is no longer engaged with the catch sealing surface 126, internal pressure in the sealed container 90 may begin to escape the bottle 100. As shown in FIG. 9, further pulling on the tab 258 continues the separation of the release 250 at the score 252 up to the attached portion 256. During further pulling of the score 252, the release 250 is further separated from the skirt 204 and any remaining internal pressure in the bottle 100 may be released. Once the release 250 is only hingedly attached to the skirt 204 by the attached portion 256, the entire crown 200 may be removed from the bottle 100. When completely removing the crown 200 from the bottle 100, the release 250 remains attached to the skirt 204. With the crown 200 removed from the bottle 100, the contents therein are accessible through the opening 108.

It is important to note that the helical configuration of the score 252 results in a spray directing portion 221 of the skirt inside surface 220 that allows for controlled release as shown in FIG. 9. Controlled release of pressure may allow for the release of pressure, liquid and/or foam in the downward direction 144. As such, when the sealed container 90 is opened, the release of pressure, liquid and/or foam may not be directed at a consumer. Instead of spraying at the consumer, the pressure, liquid and/or foam may be directed in the downward direction 144 between the spray directing portion 221 and the first sealing surface 124. With reference to FIG. 7, when this controlled release of pressure results in internal pressure, liquid and/or foam to escape from the container interior 110. This internal pressure passes between the top finish 122 and the top plate bottom portion 208. After passing the top finish 122, the internal pressure continues to escape past the bottle corner 128. After passing the bottle corner 128, the internal pressure continues between the spray directing portion 221 of the first sealing surface 124 and the skirt inside surface 220. After passing spray directing portion 221, the internal pressure, liquid and/or foam is directed in the downward direction 144.

Conditions of Sealed Container

As previously mentioned, the sealed container 90 may experience variations in internal pressure due to, for example, agitation and elevated temperatures. Various exemplary stages of this internal pressure will be described herein. As shown in FIGS. 10–13, an arbitrary scale 80 has been utilized to detail the dynamics of the internal pressure in the sealed container 90 relative to the ambient pressure exiting outside of the container. The scale 80 shows a range of 0–100 percent that represents the maximum pressure capacitance of the sealed container 90. In the condition illustrated in FIG. 10, no pressure exists in the bottle with respect to ambient conditions (i.e. external conditions), hence the scale shows a reading of zero percentage of maximum capacitance. FIG. 13, on the other hand illustrates a condition in which the internal pressure of the sealed container 90 has almost reached the maximum pressure capacitance, hence the scale 80 shows a reading of 90 percent of maximum capacitance. It has been determined that containers, such as bottle 100, containing beverages, such as beer, may have an internal pressure that varies from around 10 p.s.i. to 100 p.s.i.

For clarity of description, the physical principles of pressure acting on a surface to generate a force will be described. Force is a product of the surface area multiplied by pressure, assuming that the units are compatible. A surface, for example, top plate bottom portion 208 exposed to a pressure may be resolved into a force according to the previous equation. With the present example, if the top plate bottom portion 208 has a surface area of, for example, 1.2 square inch and is exposed to an internal pressure that is 20 pounds-per-square-inch greater than the external pressure, the top plate 202 will experience a force of 24 pounds in the upward direction 142. In another example, a force resulting from the internal pressure acting on the skirt 204 may be determined by multiplying the surface area of the skirt inside portion 220 that is not contacting the first sealing surface 124 by the pressure difference between the internal pressure and the external pressure.

Having provided an introduction to the arbitrary scale 80 adopted and the principles of pressure acting on a surface to create a force, detailed descriptions of different conditions will now be provided.

Zero Pressure Condition

Figure 10:
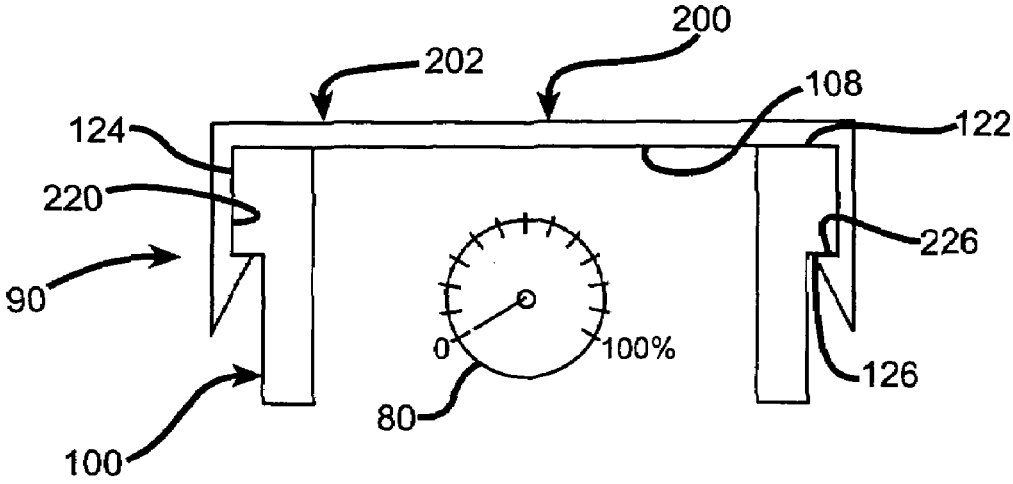
FIG. 10 is a schematic view illustrating the crown and the bottle of FIG. 1 during a zero pressure condition.

Referring to FIG. 10, a zero pressure condition exists wherein the crown 200 is securely attached to the bottle 100 thereby forming a sealed container 90 without difference between the internal and external pressure. As shown on the arbitrary scale 80, the internal pressure is essentially zero percent of the maximum capacity. This condition typically occurs just after filling and installation of the crown 200 as previously described. In this condition, the sealing surfaces are the interface between the first sealing surface 124 and the skirt inside surface 220, and the interface between the catch sealing surface 126 and the catch 226.

Top Plate Bulging Condition

Figure 11:
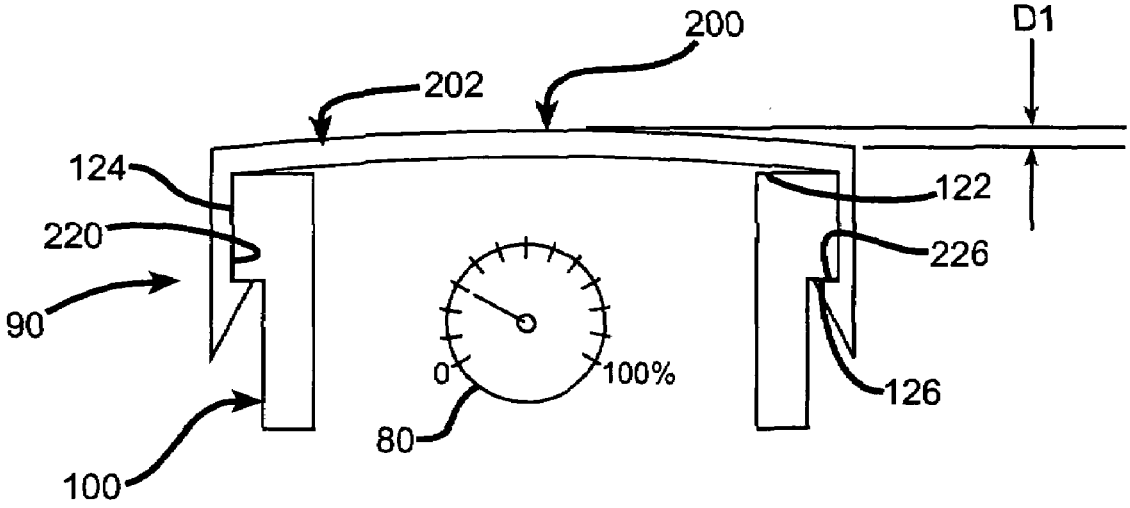
FIG. 11 is a schematic view illustrating the crown and the bottle of FIG. 1 during a top plate bulging condition.

Referring to FIG. 11, a first amount of internal pressure exists within the container resulting in bulging of the top plate 202 during a top plate bulging condition. As shown by the arbitrary scale 80, the pressure is minimal, for example 25% of maximum capacity. The top plate 202 may bulge a distance of D1. The bulging of the top plate 202 is due to force generated as a result of the surface area of the top plate bottom portion 208 being exposed to the internal pressure according to the principles previously described. In this condition, the sealing surfaces are the interface between the first sealing surface 124 and the skirt inside surface 220, and the interface between the catch sealing surface 126 and the catch 226.

Skirt Yielding Condition

Figure 12:
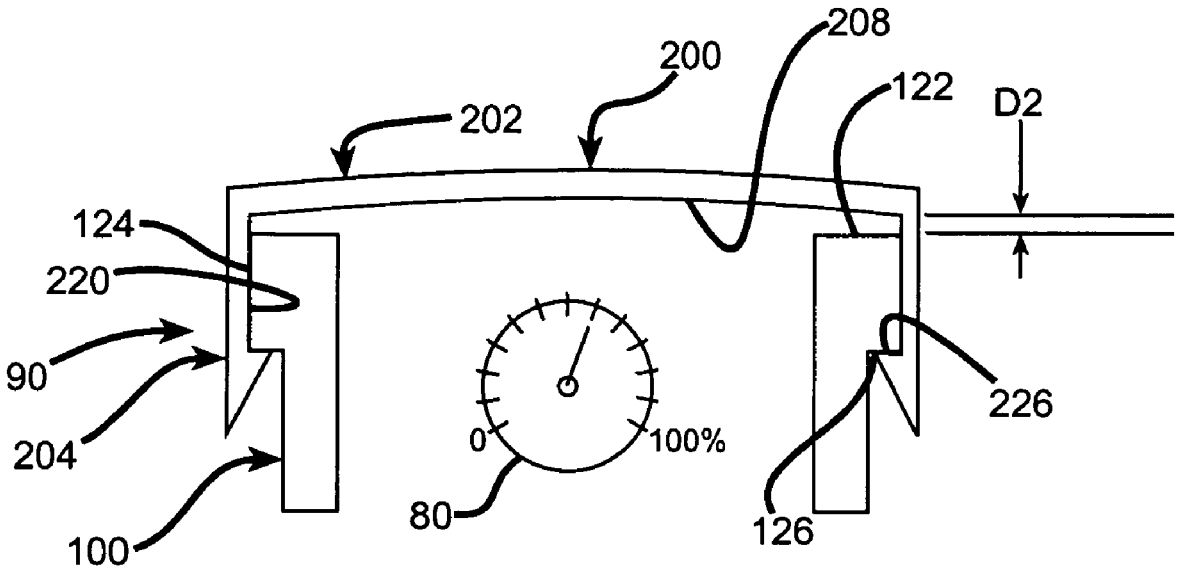
FIG. 12 is a schematic view illustrating the crown and the bottle of FIG. 1 during a skirt yielding condition.
Figure 13:
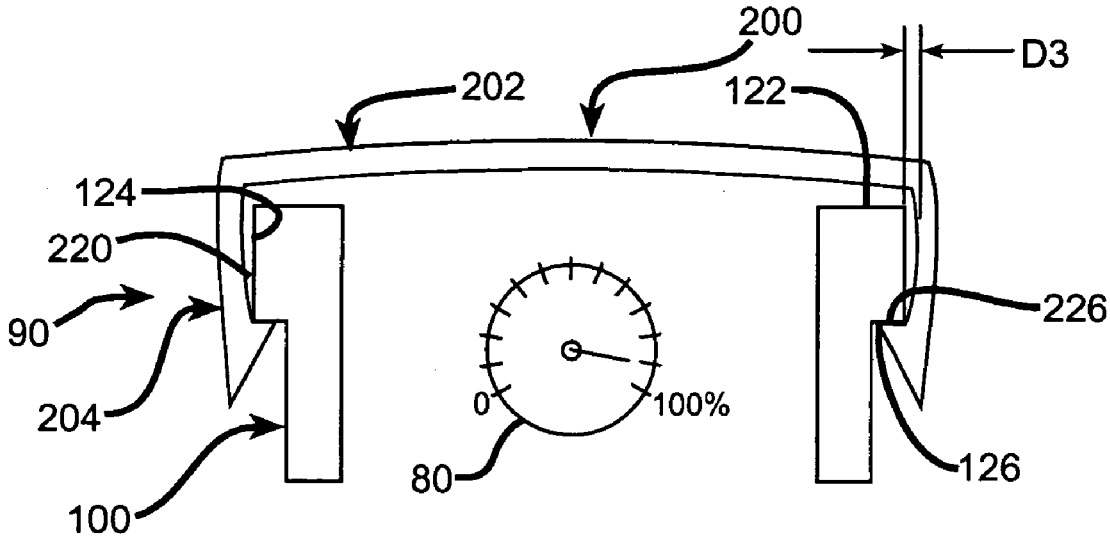
FIG. 13 is a schematic view illustrating the crown and the bottle of FIG. 1 during a skirt bulging condition.

At a slightly higher internal pressure than the top plate bulging condition, a skirt yielding condition may occur as illustrated in FIG. 12. As shown by the arbitrary scale 80 in FIG. 12, the internal pressure is slightly higher than during the top plate bulging condition, for example 55% of maximum capacity. The skirt yielding condition results in an elongation of the skirt 204 by a distance D2. This yielding of the skirt is a result of force applied by the internal pressure to the top plate bottom portion 208. This force places the skirt under tension which causes that skirt to yield (i.e. 'stretch'). During the skirt yielding condition, the sealing surfaces are the interface between the first sealing surface 124 and the skirt inside surface 220, and the interface between the catch sealing surface 126 and the catch 226.

Skirt Bulging Condition

At a slightly higher pressure than the skirt yielding condition, a skirt bulging condition may occur as illustrated in FIG. 13. As shown by the arbitrary scale 80 in FIG. 13, the pressure is slightly higher than during the skirt yielding condition, for example 90% of maximum capacity. The skirt bulging condition results in yielding of the skirt in a radial direction by a distance of D3. In essence, the diameter of the skirt 204 increases. During the skirt bulging condition, the internal pressure is acting on the skirt inside surface 220. This internal pressure acting on the skirt inside surface 220 forces the skirt in the radial direction. Therefore, the seal between the skirt inside surface 220 and the bottle first sealing surface 126 may be reduced to zero since they are not in contact with each other. During the skirt bulging condition, the sealing surface is the interface between the catch sealing surface 126 and the catch 226, more particularly between the catch sealing surface 126 and the third wall portion first surface 227.

Summation of Container Conditions

As pressure increases in the bottle 100, the surfaces providing sealing vary. An example in which the internal pressure of the bottle 100 is increasing from zero to 100 p.s.i. will now be described with respect to the sealing characteristics that occur. At the zero pressure condition (FIG. 10), the bottle is sealed due to the contact between the first sealing surface 124 and the skirt inside surface 200. As pressure increases in the bottle with respect to the external ambient pressure, the top plate 202 may begin to bulge as illustrated in the top plate bulging condition as illustrated in FIG. 11. The inside portion 208 of the top plate 202 is exposed to the internal pressure that results in the bulging of the top plate 202. In this top plate bulging condition, the force applied to the top plate 202 is countered by an increased force of contact between the catch sealing surface 126 and the catch 226. As pressure continues to increase in the bottle 100, the skirt 204 may yield during the skirt yielding condition as illustrated in FIG. 12. This skirt yielding condition is a result of the internal pressure acting on the top plate bottom portion 208 causing a force that exceeds the force-capacitance properties of the skirt 204. As such, the skirt 204 yields by the distance 'D2' (FIG. 12). Since the force acting on the top plate 202 is increasing, the resulting contact force between the catch sealing surface 126 and the catch 226 increases. During the skirt yielding condition, the bottle 100 is sealed by contact between the first sealing surface 124 and the skirt inside surface 220. As the pressure continues to increase, the skirt 204 may be exposed to an internal pressure that exceeds its ability to maintain contact between the skirt inside surface 220 and the first sealing surface 124. When the internal pressure of the bottle 100 generates a force on the skirt inside surface 220 that is greater than the contact force between the first sealing surface 124 and the skirt inside surface 220, the skirt 204 deflects in the radial direction as illustrated in the skirt bulging condition of FIG. 13. This deflection of the skirt 204 during the skirt bulging condition is illustrated as distance 'D3' in FIG. 13. During the skirt bulging condition, the contact pressure between the catch sealing surface 126 and the catch 226 continues to increase as a result of the increasing force caused by the internal pressure. Additionally, during the skirt bulging condition, the bottle 100 is sealed by the contact between the catch sealing surface 126 and the catch 226.

ALTERNATIVE EMBODIMENTS

Tapered Sealing Surface

It has been found that the present apparatus performs better with at least one tapered sealing surface. One sealing surface that may be tapered is the first sealing surface 124. Another sealing surface that may be tapered is the catch sealing surface 126. FIGS. 14–17 show various tapered sealing surfaces. It is noted that the angles of the tapered sealing surfaces illustrated in FIGS. 14–17 are exaggerated for purposes of illustration.

Figure 14:
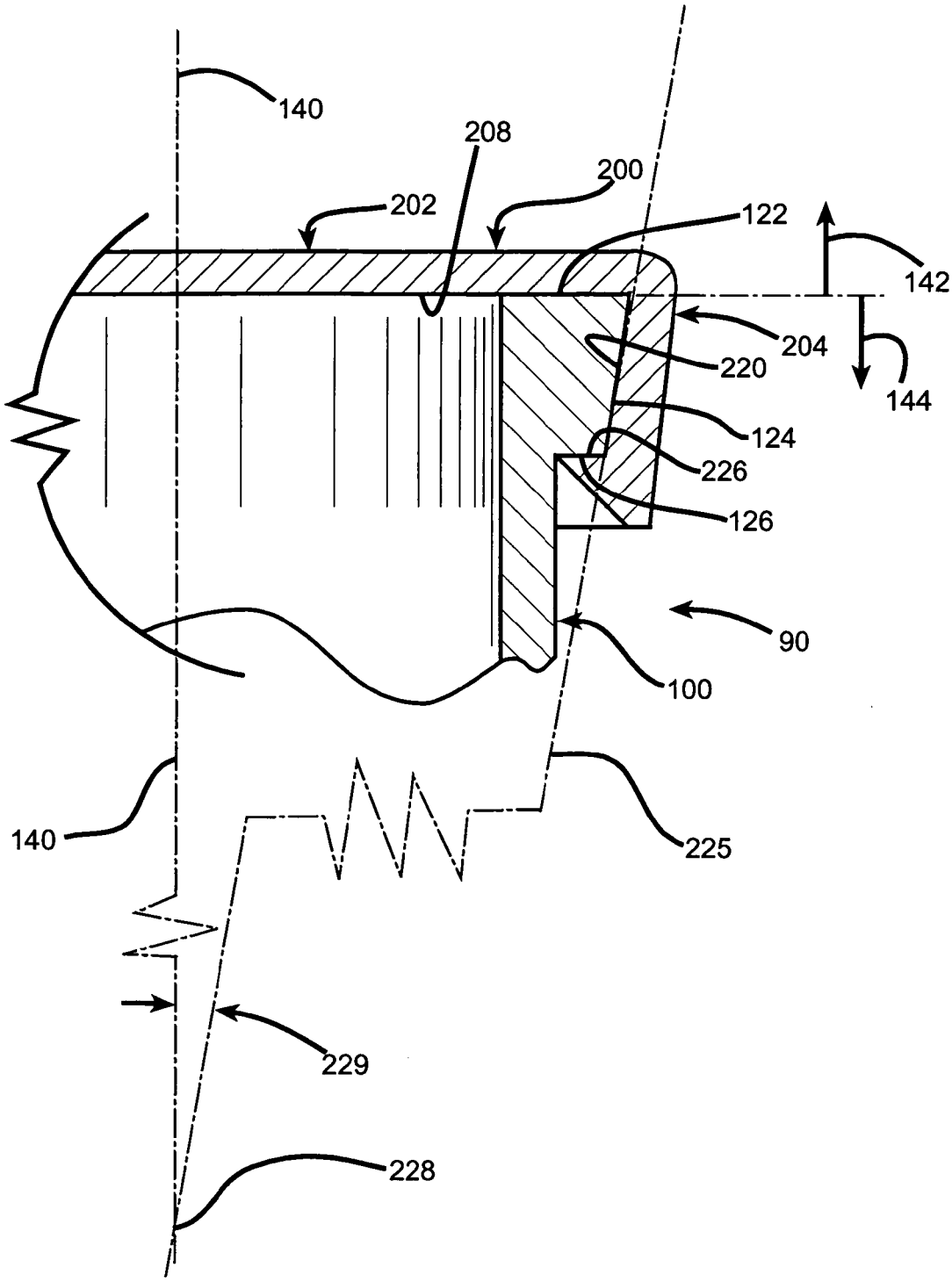
FIG. 14 is a partial cross-section view of an alternative embodiment of the crown of FIG. 1 having a tapered first sealing surface.

With reference to FIG. 14, a tapered first sealing surface 124 may be provided to increase sealing force between the crown 200 and the bottle 100. The first sealing surface 124 may have two different diameters at the top finish 122 and at the catch sealing surface 126. The first sealing surface 124 may have a larger diameter near the top finish 122 and a smaller diameter near the catch sealing surface 126. In this alternative embodiment, the skirt 204 may be provided with an angled inside surface 220 that essentially matches the taper of the first sealing surface 124. This taper of the first sealing surface 124 may be described by a skirt sealing reference geometry defined by revolving a third axis 225 about the central longitudinal axis 140. For descriptive purposes only, the third axis 225 will hereinafter be referred to as a skirt sealing reference line 225. The skirt sealing reference line 225 may intersect the central longitudinal axis 140 at a first vertex 228, hereinafter referred to as a skirt vertex 228. A first angle 229, hereinafter referred to as a skirt angle 229, indicating the angle between the skirt sealing reference line 225 and the central longitudinal axis 140 is shown in FIG. 14. The revolution of the skirt sealing reference line 225 makes the three-dimensional skirt sealing reference geometry representative of a plane upon which at least a portion of the first sealing surface 124 resides. Increases in internal pressure acting on the lower surface 208 of the top plate 202 move the top plate 202 and all features operatively attached thereto in the upward direction 142. Movement of the top plate 202 results in elongation and movement of the skirt 204 in the upward direction 142. Movement and elongation of the skirt 204 increases contact pressure between the first sealing surface 124 and the skirt inside surface 220. Increases in contact pressure result in increased sealing. In this alternative embodiment, the skirt angle 229 may any acute angle. However, the skirt angle 229 may optionally be less than 20 degrees, less than 10 degrees, more preferably between about 1 to 4 degrees, and most preferably about 2 degrees.

Figure 16:
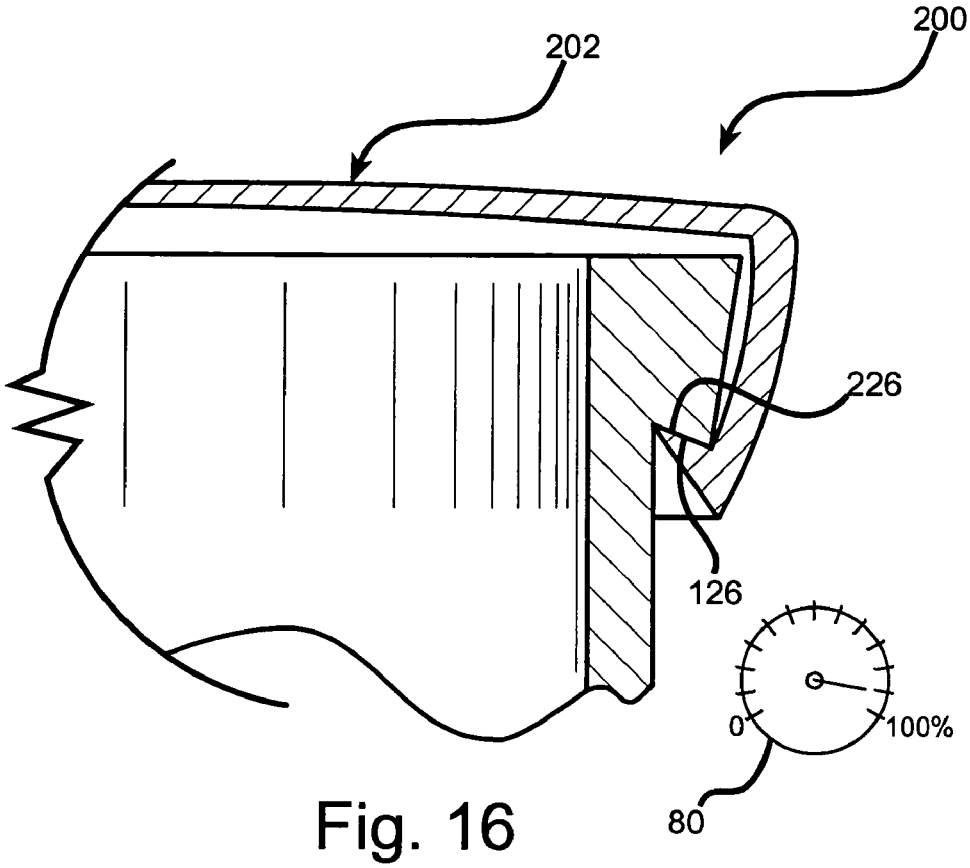
FIG. 16 is a cross-section view of the alternative embodiment of the crown of FIG. 15 having the tapered first sealing surface and the tapered catch sealing surface during the skirt bulged condition of FIG. 13.

With reference to FIG. 15, a tapered second sealing surface 126 may be provided to increase sealing force of the crown 200. The tapered second sealing surface 126 may also be referred to as the catch sealing surface 126. The catch sealing surface 126 may be angled to maximize surface area for the contact between the catch sealing surface 126 and the catch 226. In this alternative embodiment, the catch sealing surface 126 is angled to match the profile of the crown 200 in the skirt bulging condition as shown in FIG. 16. With reference to FIG. 16, this taper of the catch sealing surface 126 may result in increased contact pressure between the catch sealing surface 126 and the catch 226 in response to increases in pressure acting on the top plate 202. A catch sealing reference geometry may be defined by revolving a fourth axis 270, hereinafter referred to as a catch sealing reference line 270, about the central longitudinal axis 140.

The catch sealing reference line 270 may intersect the second axis 150 at a catch vertex 272. A second angle 274, hereinafter referred to as a catch angle 274, indicating the angle between the catch sealing reference line 270 and the second axis 150 is shown in FIG. 15. The revolution of the catch sealing reference line 270 makes the three-dimensional catch sealing reference geometry representative of the plane upon which at least a portion of the catch sealing surface 126 resides. In the exemplary embodiment as shown, the catch angle 274 may be any acute angle. However, the catch angle 274 may be less than 20 degrees, more preferably between about 1 to 4 degrees, and most preferably about 2 degrees. By matching the profile of the crown 200 in the maximum pressure condition as shown in FIG. 16, bending stress applied to the skirt 204 and the catch 226 may be minimized. Additionally, by angling the catch sealing surface 126, the seal has a maximum surface area between the catch 226 and the catch sealing surface 126. Increases in internal pressure within the bottle 100 cause the surface area between the catch 226 and the catch sealing surface 126 to experience an increase in contact pressure by principles previously described.

With further reference to FIG. 15, an exemplary embodiment is shown having a tapered first sealing surface 124 and a tapered catch sealing surface 126. The tapered first sealing surface 124 provides sealing at low pressures, but not necessarily at high pressure. Therefore, the catch sealing surface 126 has been employed to provide sealing at high pressures. Accordingly the catch sealing surface 126 provides the ability to seal the container 90 at high pressure. As such, the first sealing surface 124 provides sealing at lower pressures, and the catch sealing surface 126 provides sealing at higher pressures by principles previously described.

Pressure Relief Mechanism

Figure 17:
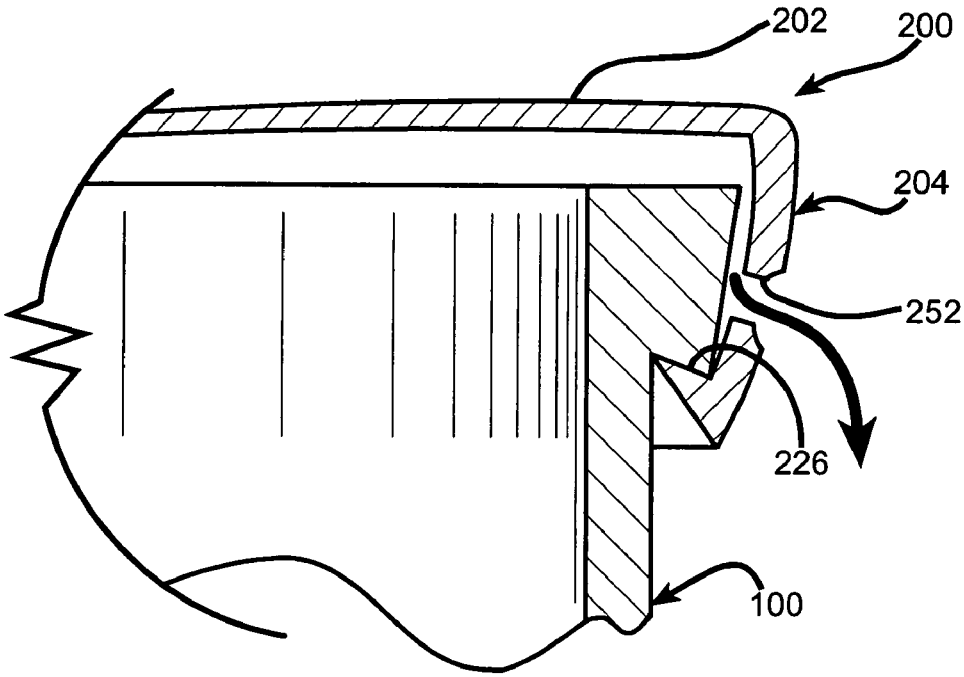
FIG. 17 is a cross-section view of an alternative embodiment of the crown of FIG. 1 having a pressure relief valve.

As previously mentioned, the sealed container 90 may experience conditions that cause an increase in the internal pressure of the sealed container 90. Such conditions may, for example, include agitation of the contents and increase of temperature. In order to limit these variations of internal pressure of the sealed container 90 to a maximum, a pressure relief mechanism may be provided. The pressure relief mechanism may limit the internal pressure to a predetermined pressure, for example 100 p.s.i. The internal pressure of the bottle 100 may be required to be limited because the bottle 100 may fail at pressures higher than 100 p.s.i., for example 150 p.s.i. As such, a margin of safety may be provided to ensure that the crown 200 or the pressure relief mechanism may release internal pressure prior to failure of the bottle 100. One mechanism to limit the maximum internal pressure may be by providing the score 252 with a portion that releases when pressure inside the sealed container 90 reaches the predetermined maximum, as shown in FIG. 17. Although the fractured score 252 results in an opened and non-consumable product, it ensures that the pressure is limited. Additionally, the pressure relief mechanism may be visibly obvious to the consumer. Other pressure relief mechanisms have been contemplated and could be alternatively incorporated. One example is a frangible portion formed on the catch 226. For another example, a feature similar to the score may be provided on the skirt 204 or the top plate 202, for example a straight groove parallel to the central longitudinal axis 140 on the skirt 204.

Push Actuated Tab

Figure 18:
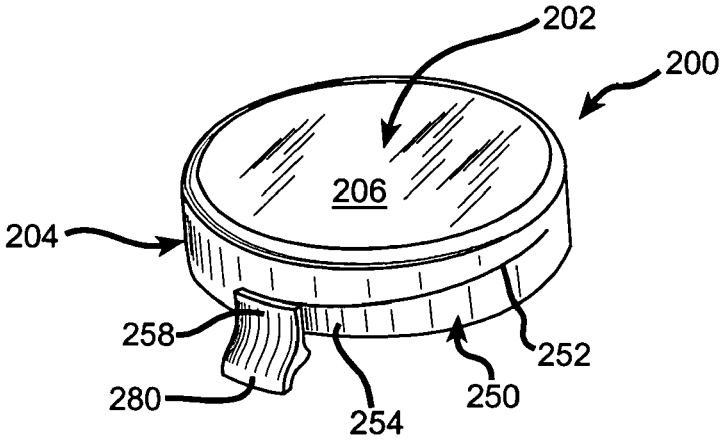
FIG. 18 is a perspective view of an alternative embodiment of the crown of FIG. 1 with a push-release tab.
Figure 19:
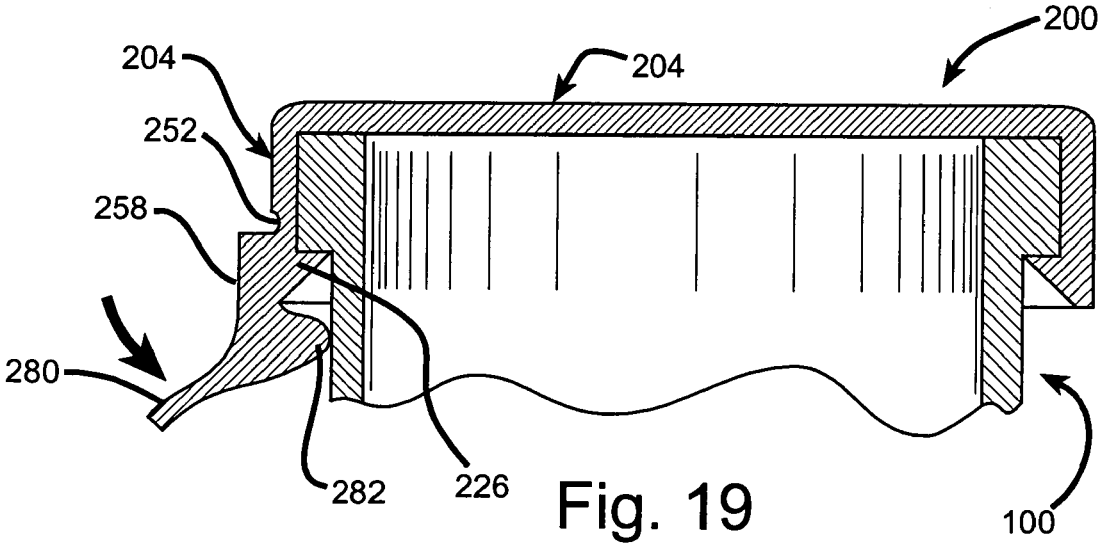
FIG. 19 is a cross-section view of the alternative embodiment of the crown having the push-release tab as illustrated in FIG. 18.

In another alternative embodiment as shown in FIGS. 18 and 19, the tab 258 may be push-actuated rather than pull-actuated. In this alternative embodiment, the tab 258 may be further provided with a cantilevered portion 280 and a fulcrum portion 282. As shown in FIG. 19, by pushing on the cantilevered portion 280, the tab 258 rotates about the fulcrum portion 282. Rotation of the tab 258 imparts stress on the score 252. Once the stress on the score 252 exceeds the strength of the score 252, the release 250 is thereby partially freed from the skirt 204 at the release portion 254. In a variation on this alternative embodiment, the fulcrum portion 282 may be omitted. In this variation, pushing on the cantilevered portion 280 causes rotation about the catch 226, thereby causing the score 252 to freed from the skirt 204.

Ribbed Skirt

Figure 20:
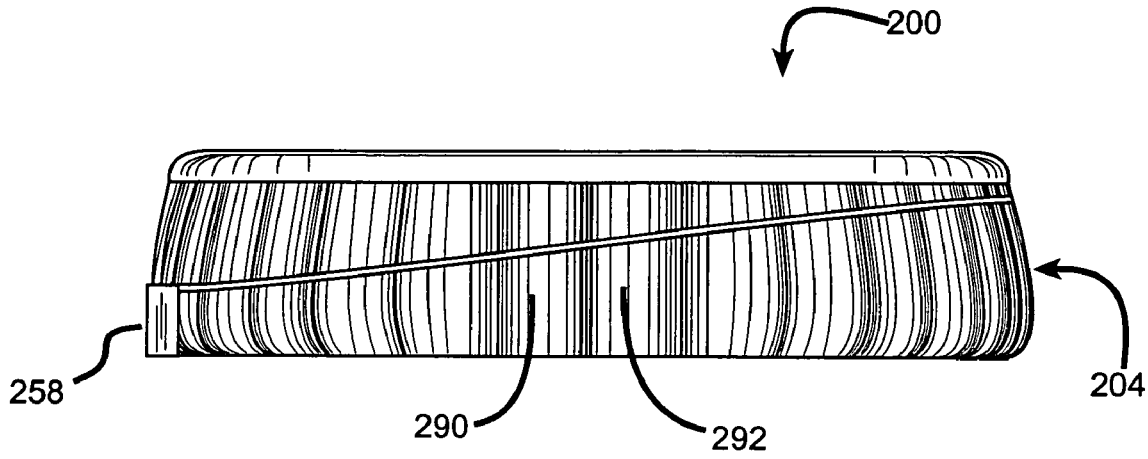
FIG. 20 is a side elevation view of an alternative embodiment of the crown of FIG. 1 having a plurality of ribs formed thereon.
Figure 21:
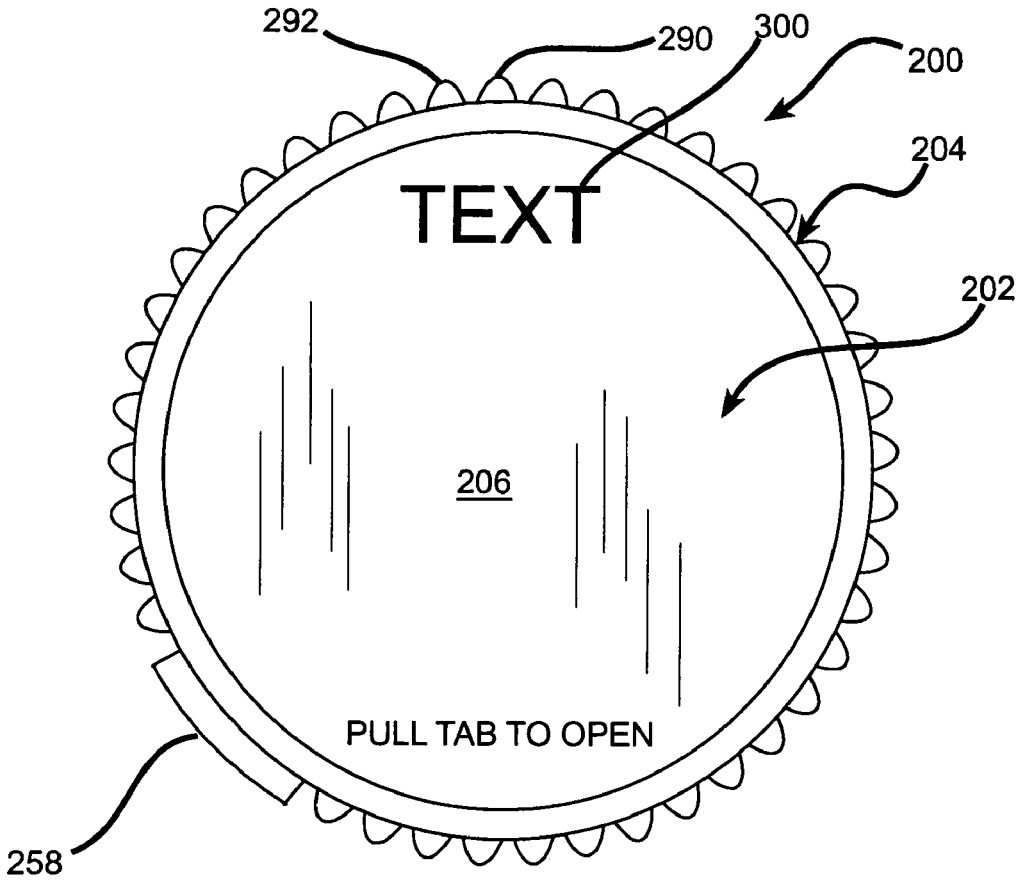
FIG. 21 is a plan view of the alternative embodiment of the crown as illustrated in FIG. 20 having the plurality of ribs and indicia thereon.

With reference to FIGS. 20 and 21, in another alternative embodiment, the skirt 204 may be provided with a plurality of ribs, such as ribs 290, 292. The ribs, such as rib 290, may provide additional thickness to the skirt 204 to minimize bulging of the skirt 204 during the skirt bulging condition (FIG. 13). Additionally, metallic finishes may be applied to the crown 200.

Liner

In another alternative embodiment, a liner (not shown) may be provided on the skirt inside surface 220 and top plate lower surface 208 of the crown 200. The liner may be a thin layer of material suitable for providing a seal. The liner may be a soft urethane, soft plastic, latex, rubber or the like. The liner may provide an additional seal should any imperfections in any of the sealing surfaces, such as the first sealing surface 124 and the catch sealing surface 126, be present. Additionally, the liner may comprise oxygen-scavengers utilized to consume any oxygen present in the interior 110 of the sealed container 90. In a variation of this alternative embodiment, the crown may be manufactured out of a material having a low durometer and provided with an oxygen scavenger therein.

Score Geometry

In another alternative embodiment, the score 252 (FIG. 2) may be provided with a varied geometry. In this alternative embodiment, the score 252 may have a varying thickness whereby the force required to break the score 252 may vary. As such, the portion of the score 252 near the release portion 254 may be easier to break than the portion of the score 252 near the attached portion 256. This varying geometry may ensure that internal pressure contained within the bottle 100 may be released in a controlled manner. Release of pressure in a controlled manner allows for pressure to be directed in the downward direction 144 between the skirt inside surface 220 and the bottle first sealing surface 124.

Indicia

With reference to FIG. 21, in another alternative embodiment, the upper surface 206 of the crown top plate 202 may be provided with indicia 300. Such indicia 300 may have instructions for opening or recycling instructions. Furthermore, the indicia 300 may provide the source of the goods being sold.

The present apparatus and method for sealing a container provide a cost effective solution for sealing containers, such as the bottle 100. The closure member 200 may be manufactured out of a material having many advantages over the conventional materials. More particularly, a plastic closure member, such as crown 200, is not vulnerable to environmental conditions in the same manner as a conventional steel crown. Furthermore, the bottle 100 has a tactile-friendly design thereby improving customer acceptance. The tactile-friendly design of the bottle 100 does not have any threads or other protrusions.

In the exemplary embodiment as shown, the geometries of the crown 200 and bottle 100 are illustrate as being circular. Although the description and drawings of an exemplary sealed container 90 are directed to a circular geometry, it is noted that this geometry may be varied. For example, octagonal, square or triangular. Additionally, it is noted that the drawings illustrate the present apparatus without fillets and chamfers. It is to be understood that various corners of the bottle 100 and the crown 200 such as bottle corner 128 (FIG. 5) may have fillets to avoid sharp corners.

While illustrative and presently preferred embodiments of the invention have been described in detail herein, it is to be understood that the inventive concepts may be otherwise variously embodied and employed and that the appended claims are intended to be construed to include such variations except insofar as limited by the prior art.

What is claimed is:

1. A method of sealing a container comprising:

providing a container defining a central longitudinal axis and a second axis intersecting said central longitudinal axis, wherein said second axis extends perpendicular to said central longitudinal axis, said container comprising:

a container interior within said container;

a container exterior oppositely disposed with respect to said container interior;

an opening providing fluid communication between said container interior and said container exterior;

a first sealing surface at least a portion of which lies on a third axis formed on said container exterior, wherein said third axis extends transverse to said second axis;

providing a closure member comprising:

a first wall portion comprising a first wall portion first surface;

a second wall portion extending from said first wall portion, said second wall portion comprising a second wall portion first surface;

dispensing a quantity of a liquid into said container interior;

moving said closure member into contact with said container;

causing at least a portion of said second wall portion first surface to sealingly engage said first sealing surface;

exposing at least a portion of said first wall portion first surface to said quantity of said liquid;

wherein said providing said container comprises providing said container further comprising:

a second sealing surface at least a portion of which lies on a fourth axis formed on said container exterior, wherein said fourth axis extends transverse to said central longitudinal axis;

wherein said providing said closure member comprises providing said closure member further comprising:

a third wall portion extending from second wall portion, said third wall portion comprising a third wall portion first surface; and wherein at least a portion of said third wall portion first surface is adjacent to said second sealing surface said container defines a first direction extending along said central longitudinal axis from said opening toward said container interior;

wherein, a first vertex is located at an intersection of said third axis and said central longitudinal axis; and wherein, said first vertex resides in said first direction from said opening.

2. The method of sealing a container of claim 1 wherein:

said container exterior is at an ambient pressure;

said container interior is at an internal pressure; and said internal pressure is at least 10 pounds per square inch greater than said ambient pressure.

3. The method of sealing a container of claim 1 wherein, a first angle is formed between said first sealing surface and said central longitudinal axis; and wherein, said first angle is less than 10 degrees.

4. The method of sealing a container of claim 1 wherein said container further defines an acute angle formed between said fourth axis and said second axis.

* * * * *